US011071984B2

(12) United States Patent
Weber

(10) Patent No.: US 11,071,984 B2
(45) Date of Patent: Jul. 27, 2021

(54) HOLDER FOR REAGENT TRAY ELEMENTS

(71) Applicant: THINXXS MICROTECHNOLOGY AG, Zweibrücken (DE)

(72) Inventor: Lutz Weber, Münchweiler (DE)

(73) Assignee: THINXXS MICROTECHNOLOGY AG, Zweibrücken (DE)

( * ) Notice: Subject to any disclaimer, the term of this patent is extended or adjusted under 35 U.S.C. 154(b) by 154 days.

(21) Appl. No.: 16/475,455

(22) PCT Filed: Dec. 5, 2017

(86) PCT No.: PCT/EP2017/081543
§ 371 (c)(1),
(2) Date: Jul. 2, 2019

(87) PCT Pub. No.: WO2018/121961
PCT Pub. Date: Jul. 5, 2018

(65) Prior Publication Data

US 2020/0023367 A1 Jan. 23, 2020

(30) Foreign Application Priority Data

Jan. 2, 2017 (EP) ..... 17150044

(51) Int. Cl.
*B01L 3/00* (2006.01)
*B01L 9/00* (2006.01)

(52) U.S. Cl.
CPC ..... *B01L 3/52* (2013.01); *B01L 9/52* (2013.01); *B01L 2200/027* (2013.01); *B01L 2200/16* (2013.01); *B01L 2300/0829* (2013.01)

(58) Field of Classification Search
CPC ..... B01L 3/52; B01L 3/50; B01L 9/52; B01L 9/50; B01L 2200/027; B01L 2200/026; B01L 2200/02; B01L 2200/00
USPC ..... 422/552, 500, 502, 50
See application file for complete search history.

(56) References Cited

U.S. PATENT DOCUMENTS

| | | | | |
|---|---|---|---|---|
| 10,232,367 | B2 | 3/2019 | Weber | |
| 2016/0167047 | A1 | 6/2016 | Weber | |
| 2018/0185841 | A1 * | 7/2018 | Weber | B01L 3/502715 |

FOREIGN PATENT DOCUMENTS

| | | | | |
|---|---|---|---|---|
| EP | 1792656 | A1 | 6/2007 | |
| EP | 2821138 | A1 | 1/2015 | |
| EP | 15173174 | * | 6/2015 | B01L 3/502715 |
| IT | MI20112073 | A1 | 5/2013 | |
| WO | WO 2015/078884 | A1 * | 6/2015 | C12Q 1/02 |

OTHER PUBLICATIONS

English Machine Translation of ITMI20112073A1 Description and Claims, 2013, obtained on Jan. 28, 2021 from https://worldwise.espacenet.com, p. 1-27.*

* cited by examiner

*Primary Examiner* — Christine T Mui
(74) *Attorney, Agent, or Firm* — Lucas & Mercanti, LLP; Klaus P. Stoffel

(57) ABSTRACT

An arrangement including a plurality of carrier elements for a reagent, which is to be introduced into a microfluidic device, in particular a flow cell, via the carrier element, and a holder receiving the plurality of carrier elements. The carrier element is fixed by positive fit in all spatial directions by the holder, keeping at least one region of the carrier element which receives the reagent clear.

17 Claims, 5 Drawing Sheets

HOLDER FOR REAGENT TRAY ELEMENTS

The present application is a 371 of International application PCT/EP2017/081543, filed Dec. 5, 2017, which claims priority of EP 17 150 044.0, filed Jan. 2, 2017, the priority of these applications is hereby claimed and these applications are incorporated herein by reference.

BACKGROUND OF THE INVENTION

The invention relates to an arrangement from a multiplicity of carrier elements for a reagent which by way of the respective carrier element is to be introduced into a microfluidic installation, in particular a flow cell, and from a mounting that receives the multiplicity of carrier elements.

In the course of the production of microfluidic flow cells (lab on chip) that contain reagents it has proven advantageous for the introduction of the reagents in a late production phase to be carried out with the aid of dedicated carrier elements that are to be finally installed in the flow cell. It can thus be avoided that introduced reagents are compromised, for example by subsequent adhesive-bonding or welding works.

A flow cell which for introducing a dry reagent by way of a carrier element has a passage that opens toward the outside is derived from EP 2 821 138 A1. By finally inserting the carrier element that receives the dry reagent into the passage, the dry reagent makes its way to the envisaged location within the flow cell, and the carrier element closes the passage in a fluid-tight manner.

The above-mentioned EP 2 821 138 A1 furthermore describes a mounting which in the process of the production of flow cells keeps ready for processing a multiplicity of carrier elements provided with the dry reagent.

SUMMARY OF THE INVENTION

The invention is based on the object of facilitating the production of microfluidic installations, in particular flow cells, that contain reagents.

This object is achieved by arrangement of the type mentioned at the outset, which is characterized in that the carrier element by way of the mounting is established in all spatial directions by way of a form-fit, by keeping clear at least one region of the carrier element that receives the reagent.

Such an arrangement according to the invention can be advantageously utilized for processing the carrier elements, in particular for applying the dry reagent and optionally for functionalizing surfaces, as well as for keeping ready the processed carrier elements for further processing in the production process of the flow cells. The carrier elements remain fixed to the mounting in each processing position. An efficient process chain can be formed by way of the arrangement according to the invention.

The carrier element is preferably established by the mounting while keeping clear a further region, in particular a handling region that is offset from the receptacle region for the dry reagent. The handling region kept dear can thus be, for example, written on or marked in the context of the processing of the carrier elements.

The carrier element is preferably configured in the manner of a plug, having the receptacle region at one end side and a handling region at another end side, wherein a widening is preferably formed at the other end.

The mounting preferably receives the carrier elements while disposing the latter in a plane and in particular in a grid arrangement.

In one particular preferred embodiment of the invention the carrier element is established by the mounting so as to be movable on account of play. Any play of the carrier element in the mounting exists in particular in such a manner that the carrier element upon releasing the form-fit can be retrieved from the mounting without any effort in terms of force. This significantly facilitates the further processing of said carrier element in the context of an optionally automated production process.

The mounting expediently comprises a carrier plate having passage openings in which the carrier elements are insertable, by way of the receptacle region leading, wherein the carrier elements are in each case preferably established in the passage openings by a holding plate which in the plug-fitting direction is disposed behind the widenings mentioned above and is connected to the carrier plate. By connecting to such a holding plate that is common to all carrier elements, a multiplicity of carrier elements that have previously been plug-fitted in the passage openings can be fixed in the mounting in one single operational step.

The holding plate preferably also has passage openings which are aligned with the carrier elements that are inserted in the passage openings in the carrier plate. At least part of the handling regions thus remains freely accessible for processing, The carrier plate is preferably connected to a frame and is in particular disposed so as to be sunk into the frame.

The holding plate is expediently also capable of being sunk into the frame and can preferably be connected to the frame in a latching manner.

The frame preferably has dimensions such that the reagent receptacle regions of the carrier elements are disposed so as to be sunk into the frame. This arrangement advantageously permits mountings that are occupied by carrier elements to be stacked in a space-saving manner without compromising the dry reagents.

Alternatively to the holding plate, each passage opening of the carrier plate can be assigned a dedicated locking mechanism for establishing the carrier element in all spatial directions, wherein said locking mechanism has, for example, elastic latching levers in particular in a diametrical disposal in pairs, said latching levers latching behind the widening and having a sliding ramp for unlatching. The sliding ramps can be mutually aligned in such a manner that unlocking of all latching levers can be performed simultaneously with the aid of a ram tool.

In one further embodiment the carrier plate is configured in multiple parts from carrier plate parts. Accordingly, the frame has a plurality of compartments which receive the plates, for example in a latching manner.

In one embodiment the carrier plate and the frame are formed integrally from a vacuum-formed sheet. In particular, holding regions composed of the frame and the carrier plates from a vacuum-formed sheet are connected to one another so as to form a strip, and the holding plate is configured as a continuous sheet strip. Such an arrangement is capable of being rolled up, and a multiplicity of prepared carrier elements that are provided with a dry reagent can be kept ready in a compact form, as in the case of a stacked arrangement.

BRIEF DESCRIPTION OF THE DRAWING

The invention will be explained further hereunder by means of exemplary embodiments and the appended drawings which relate to said exemplary embodiments. In the drawings.

DETAILED DESCRIPTION OF THE INVENTION

An arrangement illustrated in FIGS. 1 to 8 comprises carrier elements 1 for a reagent which is to be introduced into a microfluidic flow cell (not shown), and a mounting 2 that receives the carrier elements 1 in a flat grid arrangement. For example, plastics materials such as PP, PMMA, PC, PS, PE, and PEEK, but moreover also glass, metal, ceramics, composite materials, or combinations of different materials such as, for example, a plastics material body having a local or overall glass or metal coating, can be considered for producing the carrier elements 1 and parts of the mounting 2, in particular by means of injection molding.

Figure 2:
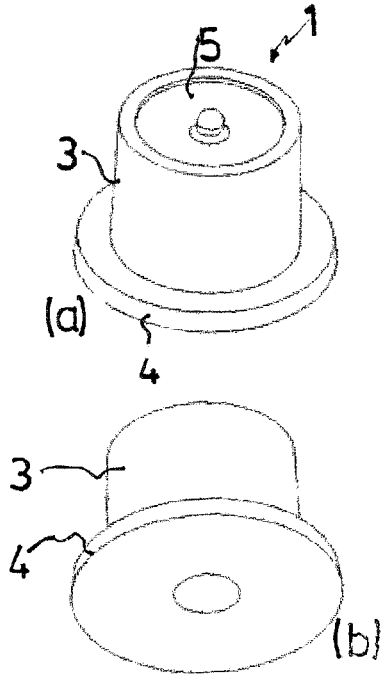
FIG. 2 shows reagent carrier elements used in the arrangement of FIG. 1, in various perspective views.
Figure 3:
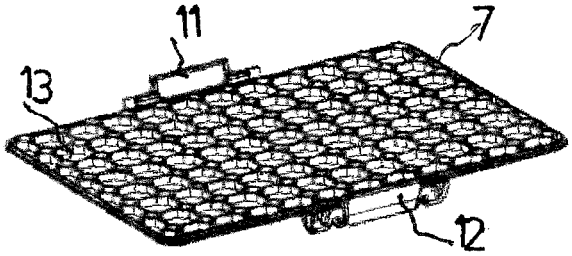
FIG. 3 shows the arrangement of FIG. 1 in a further perspective view, in an exploded.
Figure 3:
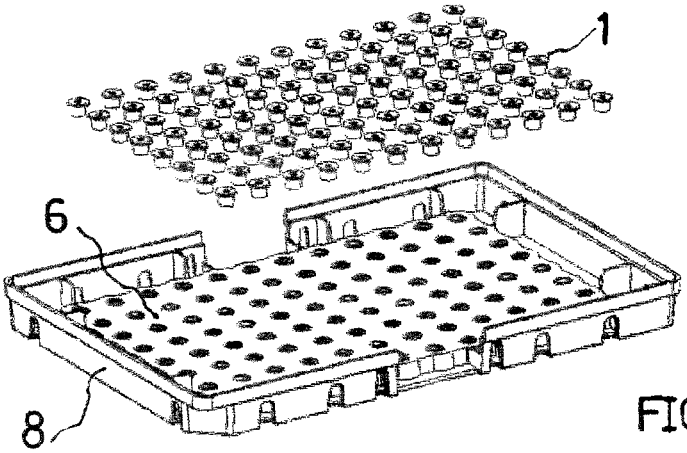
Figure 4:
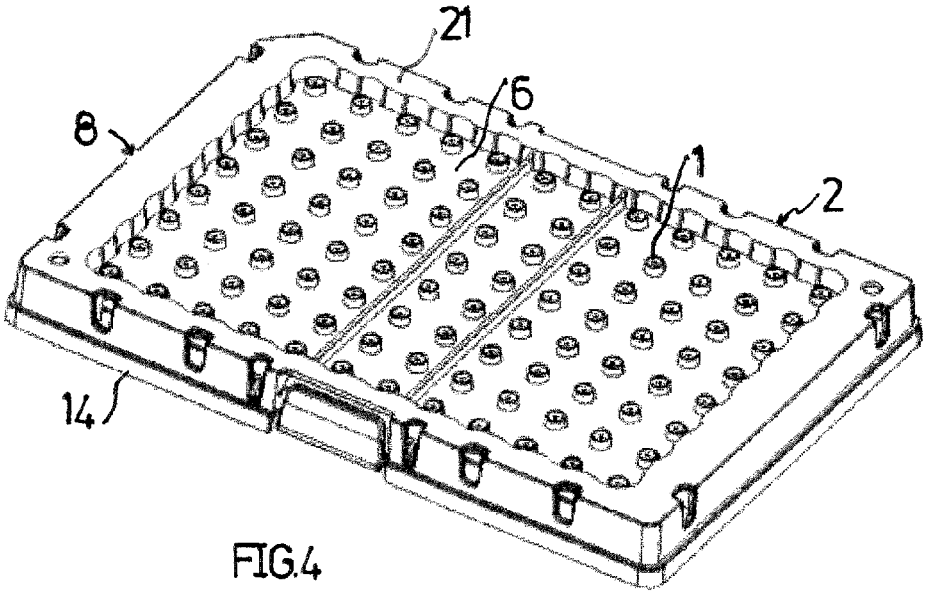
FIGS. 4 and 5 show the arrangement of FIG. 1 in the assembled state, in various perspective views.
Figure 5:
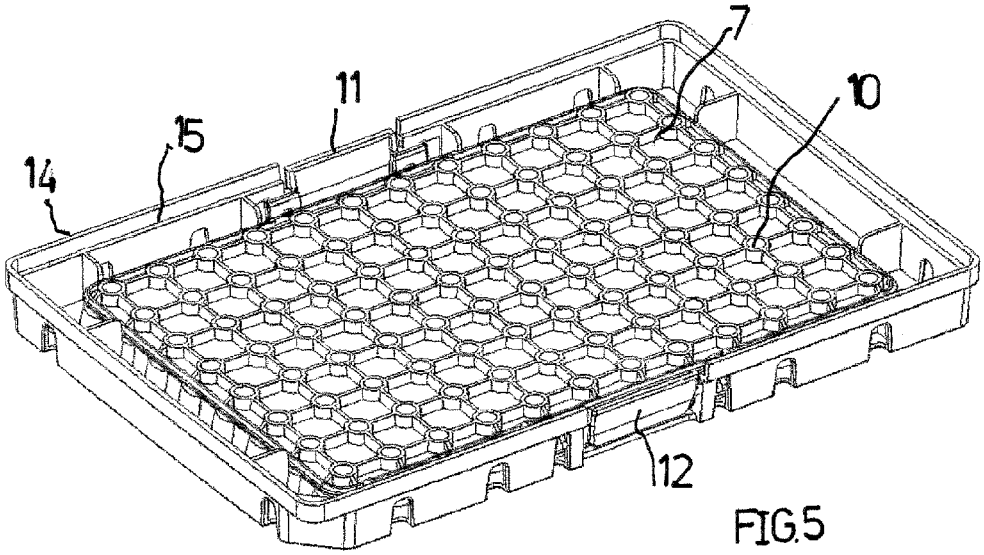

As can be seen in particular from FIG. 2, the carrier elements 1 are configured in the manner of a plug, having a slightly conical portion 3 and a widening 4 in the form of a flange at one end side. An annular countersinking at the other end side in the example forms a receptacle region 5 for the reagent.

The multiple-part holder 2 comprises a carrier plate 6 and a holding plate 7 that fixes the carrier elements 1 to the carrier plate 6.

The carrier plate 6 in the example is integrally connected to a frame 8, wherein the frame 8, on both sides of the carrier plate 6, projects from the carrier plate 6 so as to be perpendicular to the plate plane. This means that the carrier plate 6 is sunk into the frame 8, As can be seen from the figures, the frame 8 has reinforcing beads and ribs that are distributed over the circumference of said frame 8.

Passage openings 9 that are formed in a grid in the carrier plate 6 serve for receiving the carrier elements 1 which are capable of being plug-fitted in the passage openings 9 up to the point of impact of the widening 4 on the carrier plate 6. In the latter state (FIG. 4), the receptacle region 5 projects from the carrier plate 6, and the carrier element 1 in the passage opening 9 has less play parallel to the plate plane. The play is preferably less than 0.1 mm, in particular 0.05 mm. The receptacle region 5 of the carrier elements 1 is set back in relation to a surface 21 of the frame 8, said surface 21 being parallel to the plate plane.

In the plug-fitting direction, the holding plate 7 forms a barrier behind the widening 4 of the carrier elements 1 such that the carrier elements 1 in the mounting 2 are established in all spatial directions, with the exception of the slight play parallel to the plate plane.

Figure 6:
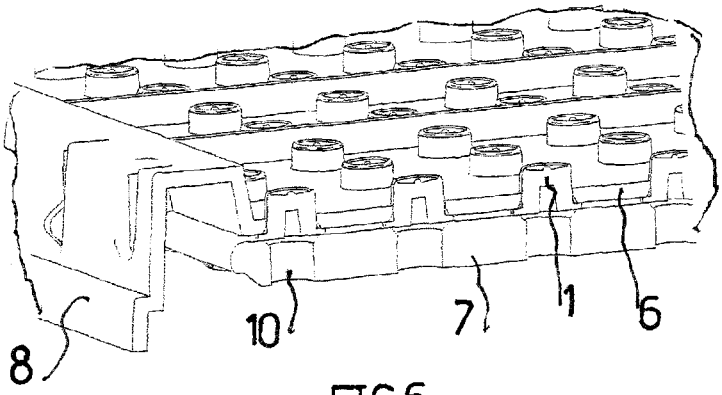
FIGS. 6 and 7 show details of the arrangement of FIGS. 4 and 5.
Figure 7:
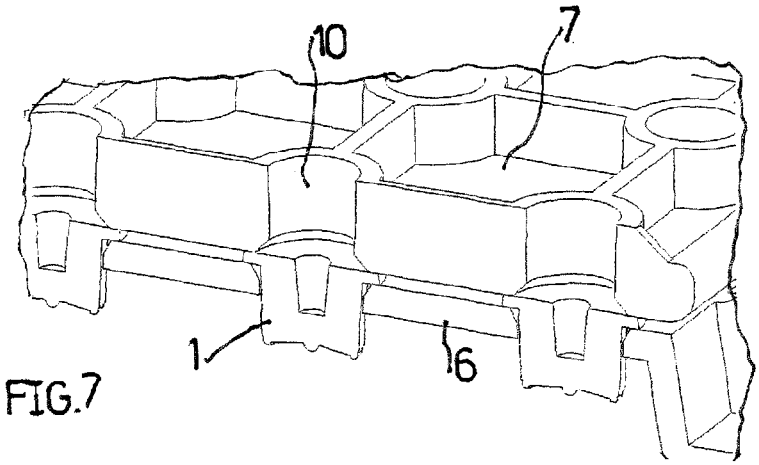

As can be seen in particular in FIGS. 6 and 7, the holding plate 7 has passage openings 10 that are aligned with the passage openings 9, the widened end side of the mounted carrier elements 1 that forms a handling region for the carrier elements 1 being at least partially accessible by way of said passage openings 10.

The holding plate 7 is capable of being latched to the frame 8 by way of elastic latching elements 11 and 12. The holding plate 7 on the side that faces away from the carrier plate 6 has a stabilizing honeycomb structure 13 which avoids material accumulations. The holding plate 7 in the latched state is sunk into the frame 8.

Figure 8:
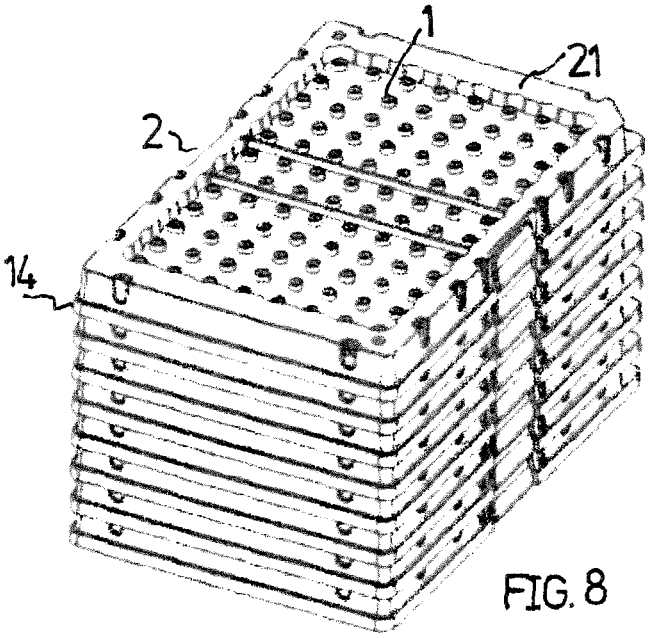
FIG. 8 shows a plurality of the arrangements of FIGS. 4 and 5 in the stacked state.

The frame 8 has a terminal periphery 14 which is widened in an encircling manner and which forms a stack seat 15 on which a neighboring arrangement by way of the frame surface 21 bears in a stack according to FIG. 8. As is shown in FIG. 8, stacked packs in which the reagents on account of the offset of the receptacle regions 5 in relation to the surface 21 are protected from physical contact can be formed. The stacked packs can be sealed in sheets and optionally be vacuum-packed or be placed under a protective inert-gas atmosphere.

Figure 1:
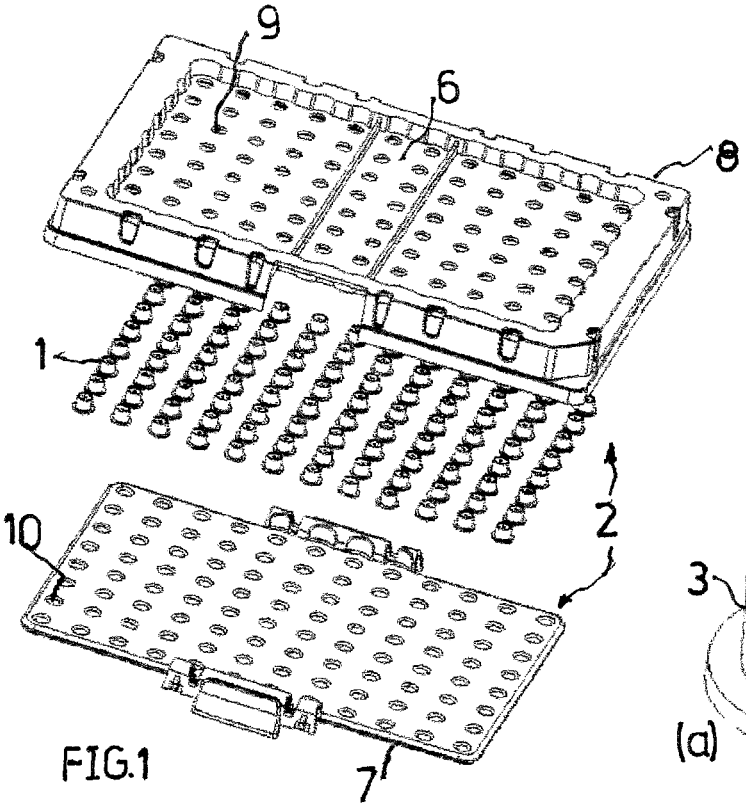
FIG. 1 shows an arrangement according to the invention in an exploded, in a perspective view.
Figure 9:
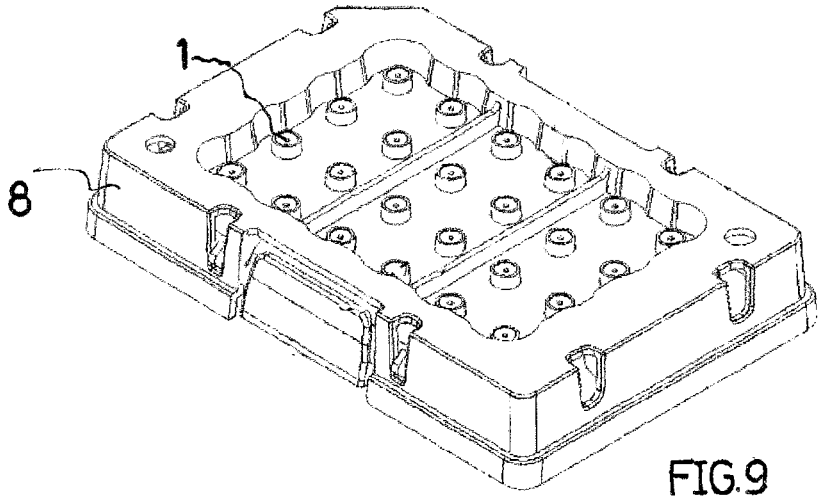
FIGS. 9 and 10 show further exemplary embodiments for an arrangement according to the invention, in perspective views.

FIG. 9 shows an embodiment which is reduced in size as compared to the embodiment of FIG. 1.

Figure 10:
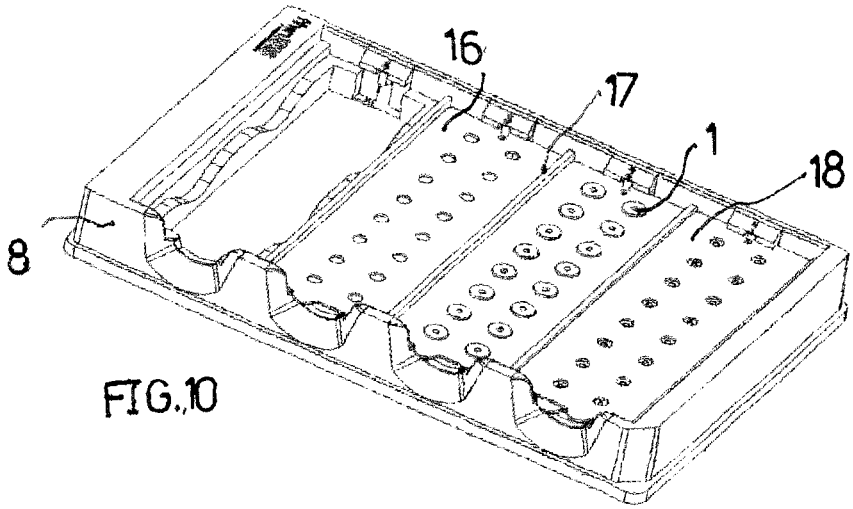

FIG. 10 shows an exemplary embodiment having a carrier plate that is formed from four carrier plate parts 16, wherein the carrier plate parts 16 are capable of being snap-fitted into a frame 8 which has cross stays 17. Four holding plate parts 18 which are likewise capable of being snap-fitted and which in the example are congruent with the carrier plate parts 16 are likewise formed. The carrier plate parts 16 and holding plate parts 18 are, for example, metallic and optionally etched stamped parts.

FIG. 10 shows an empty frame compartment, a frame compartment having a carrier plate part 16, a frame compartment having a populated carrier plate part 16, and a frame compartment having a carrier plate part 16 (not visible) and a holding plate part 18.

Figure 11:
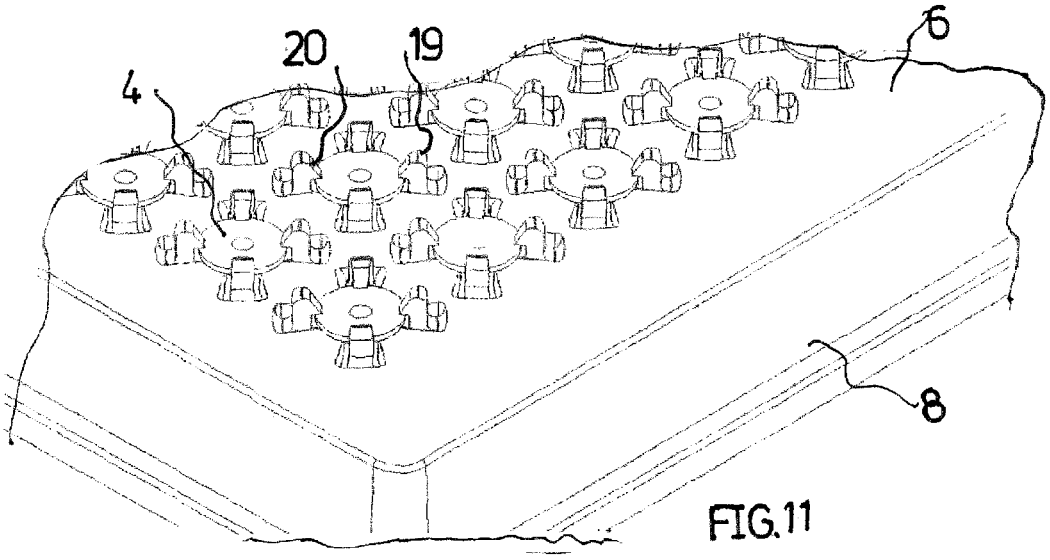
FIG. 11 shows an alternative mounting mechanism for reagent carrier elements.
Figure 12:
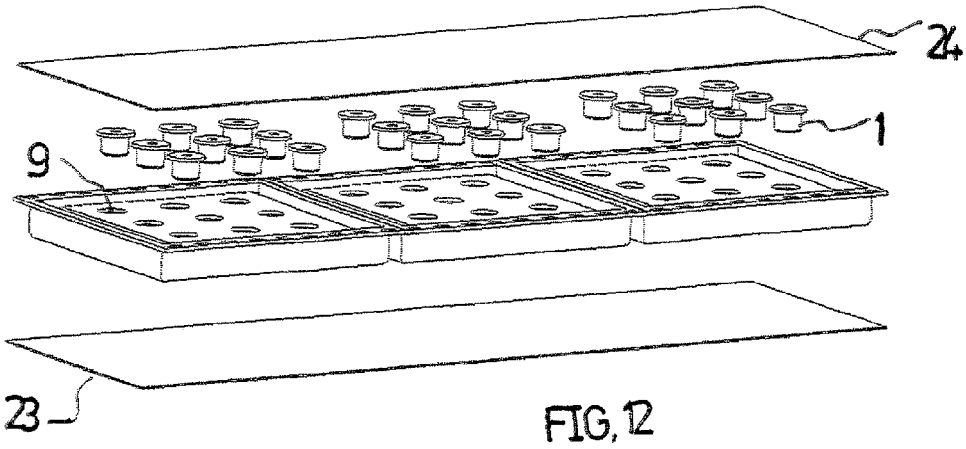
FIGS. 12 to 15 show a third exemplary embodiment for an arrangement according to the invention, having a mounting that in part is produced from vacuum-formed sheet material.
Figure 13:
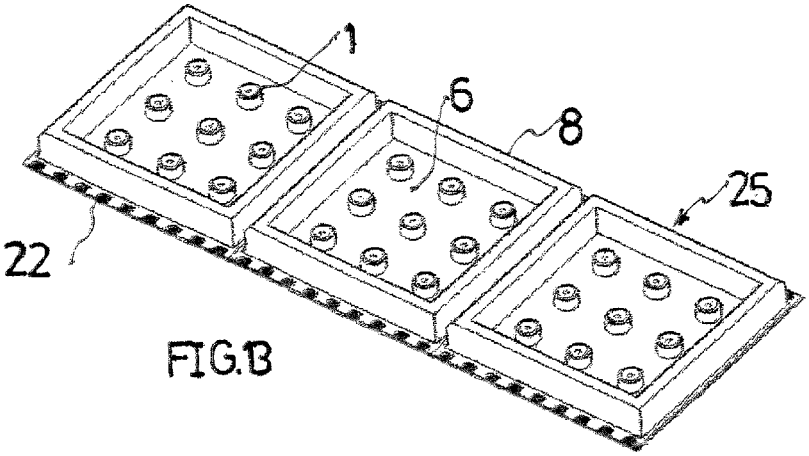
Figure 14:
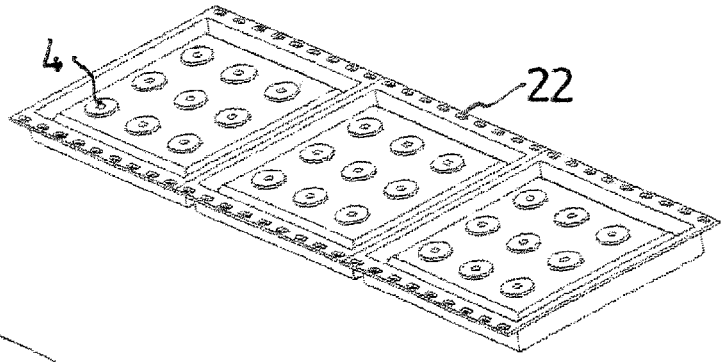

FIG. 11 shows a carrier plate 6 that is integrally connected to a frame 8, said carrier plate 6 having passage openings 9, wherein each individual passage opening 9 is assigned a dedicated holding mechanism for a carrier element 1, a common holding plate for all carrier elements 1 being superfluous on account of said dedicated holding mechanism.

In the example shown, each holding mechanism has four elastically bendable latching levers 19 in a diametrical disposal in pairs, said latching levers 19 being integrally connected to the carrier plate 6 and latching behind the widening 4 of the respective carrier element 1 and engaging behind the carrier element 1. The diametrically opposite latching levers 19 in pairs have in each case one sliding ramp 20 so that all four latching levers can be collectively expanded by a ram tool, and releasing of the locking mechanism is possible on account thereof.

FIGS. 12 to 15 show an exemplary embodiment in which the mounting parts, as opposed to the preceding exemplary embodiments, have not been produced by injection-molding or printing, or from metal, but solely from sheet material.

The arrangement shown comprises a strip in which holding regions 25 which are sequential in the longitudinal direction of the strip and which have frames 8 and carrier plates 6 are formed by vacuum-forming, and passage openings 9 for receiving carrier elements 1 are stamped into the carrier plates 6. The vacuum-formed sheet has perforated peripheries 22, wherein transporting means can engage in the perforated holes.

A holding plate that firmly holds the carrier elements 1 in the carrier plate 6 is continuously embodied as a sheet strip 24 and is adhesively bonded to the strip that contains the carrier plates 6. A cover 23 that as a strip is continuous covers the set-back exposed receptacle regions of the carrier elements 1.

Figure 15:
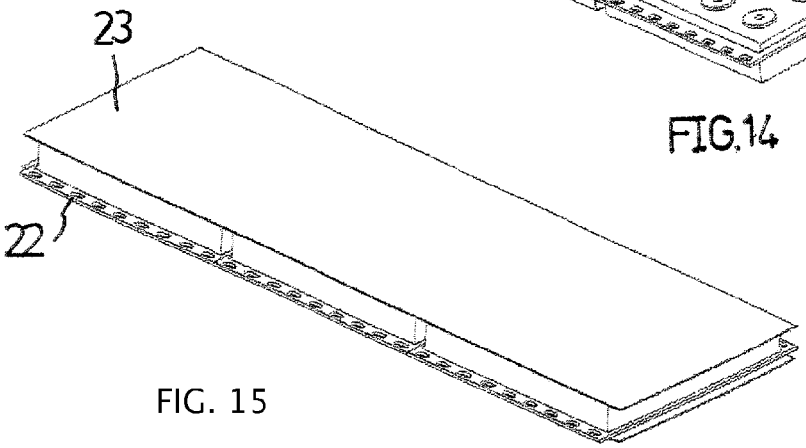

The arrangement shown complete with the cover 23 in FIG. 15 is capable of being rolled up as an entity.

The invention claimed is:

1. An arrangement comprising: a plurality of carrier elements for a reagent to be introduced via the carrier elements into a microfluidic installation; a mounting that receives the plurality of carrier elements, wherein each of the carrier elements by way of the mounting is secured in all spatial directions by way of a form-fit, while keeping clear at least one receptacle region of the carrier element that receives the reagent, wherein each of the carrier elements is configured as a plug having the receptacle region at a first end side and a widening that forms a handling region at a second end side, wherein the mounting comprises a carrier plate having passage openings formed in a modular grid and in which the carrier elements are insertable leading with the receptacle region, wherein the widening of the carrier elements is formed by a flange, the carrier elements having a conical portion whereby the carrier elements are introducible into the passage openings to a stop position where the flange stops on the carrier plate so that the carrier elements have play parallel to a plane of the carrier plate, wherein in the stop position the receptacle region of the carrier elements projects from the carrier plate; and a holding plate common to all of the carrier elements and connected to the carrier plate, or a dedicated locking mechanism assigned to each of the passage openings of the carrier plate and configured to engage the flange on a side of the flange that faces away from the carrier plate.

2. The arrangement according to claim 1, wherein the carrier element is established by way of the mounting while keeping clear a further region.

3. The arrangement according to claim 2, wherein the further region is offset from the receptacle region and serves for handling the carrier element.

4. The arrangement according to claim 1, wherein the mounting is configured to receive the carrier elements and dispose the carrier elements in a plane.

5. The arrangement according to claim 4, wherein the carrier elements are arranged in a grid.

6. The arrangement according to claim 1, wherein the carrier element is mounted with play.

7. The arrangement according to claim 1, wherein the holding plate has passage openings aligned with the carrier elements that are inserted in the passage openings of the carrier plate.

8. The arrangement according to claim 1, further comprising a frame, wherein the carrier plate is connected to the frame.

9. The arrangement according to claim 8, wherein the carrier plate is sunk into the frame.

10. The arrangement according to claim 8, wherein the holding plate is configured to be sunk into the frame.

11. The arrangement according to claim 10, wherein the holding plate is connected to the frame in a latching manner.

12. The arrangement according to claim 8, wherein the reagent receptacle regions of the carrier elements are disposed so as to be sunk into the frame.

13. The arrangement according to claim 1, wherein the locking mechanism has elastic latching levers in a diametrical arrangement in pairs, said latching levers latching behind the widening and having a sliding ramp for unlatching.

14. The arrangement according to claim 1, wherein the carrier plate is configured in multiple parts from carrier plate parts.

15. The arrangement according to claim 1, wherein the arrangement is stackable.

16. The arrangement according to claim 8, wherein the carrier plate and the frame are formed integrally from a vacuum-formed sheet.

17. The arrangement according to claim 16, wherein holding regions composed of the frame and the carrier plates from a vacuum-formed sheet are connected to one another so as to form a strip, and a holding plate configured as a continuous sheet strip holds the carrier elements in the carrier plates, and/or a plurality of holding regions are capable of being rolled up.

* * * * *